US008944927B2

(12) United States Patent
Huntsberger et al.

(10) Patent No.: US 8,944,927 B2
(45) Date of Patent: Feb. 3, 2015

(54) INFANT'S SWING WITH RECONFIGURABLE SEAT

(71) Applicant: Mattel, Inc., El Segundo, CA (US)

(72) Inventors: Kurt J. Huntsberger, Arcade, NY (US); Kevin Crane, Orchard Park, NY (US); Philip R. Pyrce, Getzville, NY (US)

(73) Assignee: Mattel, Inc., El Segundo, CA (US)

( * ) Notice: Subject to any disclaimer, the term of this patent is extended or adjusted under 35 U.S.C. 154(b) by 68 days.

(21) Appl. No.: 13/859,935

(22) Filed: Apr. 10, 2013

(65) Prior Publication Data

US 2013/0288811 A1 Oct. 31, 2013

Related U.S. Application Data

(60) Provisional application No. 61/623,310, filed on Apr. 12, 2012.

(51) Int. Cl.

| | |
|---|---|
| ***A63G 9/16*** | (2006.01) |
| ***A47D 13/10*** | (2006.01) |
| ***A47D 13/00*** | (2006.01) |
| *A47C 3/02* | (2006.01) |

(52) U.S. Cl.

CPC ..... *A47D 13/105* (2013.01); *A47D 13/00* (2013.01)

USPC ..... 472/119; 297/281

(58) Field of Classification Search

USPC ..... 472/118–125; 297/274, 277, 278, 281, 297/282

See application file for complete search history.

(56) References Cited

U.S. PATENT DOCUMENTS

| | | | |
|---|---|---|---|
| 854,183 | A | 5/1907 | Spice |
| 1,950,042 | A | 3/1934 | Upper |
| 2,687,167 | A | 8/1954 | Janesick |
| 2,704,111 | A | 3/1955 | Wunderlich |
| 2,779,389 | A | 1/1957 | Pearl |
| 3,049,350 | A | 8/1962 | Walker |
| 3,078,092 | A | 2/1963 | Mills |
| 3,528,657 | A | 9/1970 | Krupsky |
| 4,240,625 | A | 12/1980 | Meeker |
| 4,324,432 | A | 4/1982 | Eldon, III et al. |
| 4,697,845 | A | 10/1987 | Kamman |
| 4,776,415 | A | 10/1988 | Brice |
| 4,805,902 | A | 2/1989 | Casagrande |
| 4,822,033 | A | 4/1989 | Kohus et al. |

(Continued)

FOREIGN PATENT DOCUMENTS

FR 2631847 A1 12/1989

OTHER PUBLICATIONS

International Search Report, PCT/US2013/036077, dated Jun. 28, 2013.

*Primary Examiner* — Kien Nguyen

(74) *Attorney, Agent, or Firm* — Edell, Shapiro & Finnan, LLC

(57) ABSTRACT

A child's swing support structure includes a seat assembly having a first configuration and a second configuration. The seat of the swing support structure is able to be configured in a reclined configuration for infants or an upright configuration for toddlers. The seat can be locked into the upright configuration when a tray is connected to the seat of the swing support structure. The seat is rotatably coupled to a frame of the swing support structure, where the swing is free to swing back and forth with respect to the frame. Furthermore, a drive mechanism may be attached to the frame for mechanically swinging the seat back and forth.

20 Claims, 8 Drawing Sheets

(56) References Cited

U.S. PATENT DOCUMENTS

| | | | | |
|---|---|---|---|---|
| 4,948,120 | A | 8/1990 | Krueger et al. | |
| 5,046,651 | A | 9/1991 | Dagdagan | |
| 5,201,693 | A | 4/1993 | Sparkes | |
| 5,326,327 | A | 7/1994 | Stephens et al. | |
| 5,499,949 | A | 3/1996 | Heubl | |
| D368,816 | S | 4/1996 | Mitchell et al. | |
| 5,526,893 | A | 6/1996 | Higer | |
| 5,617,594 | A | 4/1997 | Chien | |
| 5,669,664 | A | 9/1997 | Perego | |
| D392,126 | S | 3/1998 | Sack | |
| 5,769,727 | A | 6/1998 | Fair et al. | |
| 5,791,999 | A | 8/1998 | Lauro et al. | |
| 5,803,817 | A | 9/1998 | Stern | |
| 5,803,818 | A | 9/1998 | Tseng | |
| 5,833,545 | A | 11/1998 | Pinch et al. | |
| 5,846,136 | A | 12/1998 | Wu | |
| D412,067 | S | 7/1999 | Wu | |
| 5,975,631 | A | 11/1999 | Fair et al. | |
| 5,984,791 | A | 11/1999 | Fair et al. | |
| 6,010,410 | A | 1/2000 | Lauro et al. | |
| 6,022,277 | A | 2/2000 | Jankowski | |
| 6,024,412 | A | 2/2000 | Kain et al. | |
| 6,027,409 | A | 2/2000 | Favorito et al. | |
| 6,059,667 | A | 5/2000 | Pinch | |
| 6,178,978 | B1 | 1/2001 | Rieber | |
| D440,778 | S | 4/2001 | Wang | |
| 6,251,023 | B1 | 6/2001 | Lauro et al. | |
| 6,319,138 | B1 | 11/2001 | Fair et al. | |
| 6,343,838 | B1 | 2/2002 | Bagshaw | |
| D456,189 | S | 4/2002 | Flannery et al. | |
| D459,099 | S | 6/2002 | Liu | |
| 6,402,233 | B1 | 6/2002 | Tseng | |
| 6,421,901 | B2 | 7/2002 | Sitarski et al. | |
| D461,062 | S | 8/2002 | Wu | |
| 6,474,736 | B1 | 11/2002 | Brown | |
| 6,500,072 | B1 | 12/2002 | Myers et al. | |
| 6,511,123 | B1 | 1/2003 | Sitarski et al. | |
| 6,561,915 | B2 | 5/2003 | Kelly et al. | |
| 6,645,080 | B1 | 11/2003 | Greger et al. | |
| 6,702,685 | B2 | 3/2004 | Mahlstedt et al. | |
| D490,993 | S | 6/2004 | Longenecker et al. | |
| 6,857,965 | B2 | 2/2005 | Pook et al. | |
| 6,896,624 | B2 | 5/2005 | Longenecker et al. | |
| 6,902,489 | B2 | 6/2005 | Greger et al. | |
| 6,916,249 | B2 | 7/2005 | Meade | |
| 6,994,630 | B2 | 2/2006 | Paesang | |
| 7,040,995 | B2 | 5/2006 | Lee | |
| 7,052,403 | B2 | 5/2006 | Ransil et al. | |
| 7,081,052 | B2 | 7/2006 | Greger et al. | |
| D543,059 | S | 5/2007 | Haut | |
| 7,219,959 | B2 | 5/2007 | Ransil et al. | |
| 7,258,618 | B2 | 8/2007 | Haut | |
| 7,258,619 | B2 | 8/2007 | Tuckey | |
| 7,364,235 | B2 | 4/2008 | Chen et al. | |
| 7,438,644 | B2 | 10/2008 | Gubitosi et al. | |
| 7,475,942 | B2 * | 1/2009 | Boyle et al. | 297/278 |
| 7,507,163 | B2 | 3/2009 | Haut | |
| 7,717,800 | B2 | 5/2010 | Pyrce | |
| 7,727,076 | B2 | 6/2010 | Bapst et al. | |
| 7,775,893 | B2 | 8/2010 | Blumenthal | |
| 7,780,237 | B2 | 8/2010 | Chen et al. | |
| 7,780,500 | B2 | 8/2010 | Sonner et al. | |
| 7,837,569 | B2 | 11/2010 | Ouellet | |
| 7,878,915 | B2 | 2/2011 | Myers et al. | |
| 7,918,499 | B2 | 4/2011 | Tuckey et al. | |
| 7,971,933 | B2 | 7/2011 | Tuckey et al. | |
| 8,152,647 | B2 | 4/2012 | Tuckey et al. | |
| 8,550,556 | B2 * | 10/2013 | Asbach | 297/281 |
| 2003/0020317 | A1 | 1/2003 | Keegan et al. | |
| 2003/0160487 | A1 | 8/2003 | Flannery et al. | |
| 2004/0259647 | A1 | 12/2004 | Wood et al. | |
| 2008/0020854 | A1 | 1/2008 | Tuckey et al. | |
| 2009/0005186 | A1 | 1/2009 | Tseng | |
| 2009/0033133 | A1 | 2/2009 | Barron et al. | |
| 2009/0181780 | A1 | 7/2009 | Myers et al. | |
| 2010/0062867 | A1 | 3/2010 | Chen | |
| 2010/0159428 | A1 | 6/2010 | Grasing et al. | |
| 2010/0264719 | A1 | 10/2010 | Burns et al. | |
| 2010/0279837 | A1 | 11/2010 | Stengel | |
| 2010/0298057 | A1 | 11/2010 | Lu | |
| 2010/0320821 | A1 | 12/2010 | Trapp et al. | |
| 2011/0028228 | A1 | 2/2011 | Zhang | |
| 2011/0092301 | A1 | 4/2011 | Myers et al. | |
| 2011/0227375 | A1 | 9/2011 | Asbach | |
| 2011/0227384 | A1 | 9/2011 | Huntsberger et al. | |
| 2011/0230271 | A1 | 9/2011 | Szymanski | |
| 2011/0241396 | A1 | 10/2011 | Brown et al. | |
| 2012/0046117 | A1 | 2/2012 | Zhang et al. | |

* cited by examiner

INFANT'S SWING WITH RECONFIGURABLE SEAT

CROSS-REFERENCE TO RELATED APPLICATIONS

This application claims priority to and the benefit of U.S. Non-Provisional Patent Application No. 61/623,310, filed Apr. 12, 2012, entitled "Infant's Swing with Reconfigurable Seat" the entire disclosure of which is incorporated herein by reference in its entirety.

FIELD OF THE INVENTION

The present invention relates to an infant swing, and in particular a powered infant swing with a seat that may be reconfigured between a reclined configuration and an upright configuration.

BACKGROUND OF THE INVENTION

Various infant support structures for supporting an infant or child above a support surface are known, such as swings and rocker seats. Such support structures provide an enjoyable and safe area for a child or infant. Further, different support structures are used for children at different ages and stages of development. When the child is an infant, it is more desirable for the child to be in a reclined configuration, where the child is laying in the swing support structure. At other times, when the child is older and able to support his or her own head and body, it is more desirable for the child to be in a swing having an upright configuration. As a result, parents and care givers often utilize various types of such support structures as the child grows. However, obtaining and maintaining a variety of support structures may be expensive and cumbersome, given they are often expensive and bulky. Moreover, it would be more desirable for parents and care givers to obtain a swing support system that can be used from a child's infant years through their growth of the toddler years.

Therefore, there is a need for a swing support structure with a reconfigurable seat that may be utilized in either a reclined configuration or an upright (non-reclined) configuration. Further, there is a need for swing seat that is efficient and easy to transition between configurations.

SUMMARY OF THE INVENTION

The present invention is directed to a reconfigurable seat of a child's swing support structure. The swing may include a frame having a lower portion and an upper portion. A housing may be coupled to the upper portion. A drive mechanism may be disposed within the housing. Pivotally coupled to the housing is at least one hanger tube. Coupled to the end of the hanger tube is a seat that is reconfigurable between a reclined position and an upright position. The seat may be biased to be in the reclined position unless it is locked into the upright position. The seat may contain a removable tray that, when attached to the seat, locks the seat into the upright position.

The present invention is directed to a swing that includes a frame with a lower portion that engages a support surface and an upper portion, a housing portion coupled to the upper portion of the frame, the housing portion including a seat tube that extends substantially downward from the housing portion, a reconfigurable seat that is coupled to the seat tube having a top portion and a bottom portion and is reconfigurable between a first configuration and a second configuration, the seat includes a removable tray and a rotating hub with a first configuration and a second configuration, and a drive mechanism that is coupled to the housing portion, the drive mechanism is configured to swing the seat back and forth relative to the swing frame, and when the removable tray is connected to the seat, the tray locks the hub into the first configuration, which retains the seat in the first configuration.

In one embodiment, the seat further includes retaining tabs configured to the bottom portion of the seat for storing the removable tray when it is not in use. The seat and the hub are biased to be in the second configuration when the removable tray is not attached to the seat. Furthermore, a seat cover is disposed on the top portion of the seat.

In one embodiment, the swing includes a removable seatback tube configured to connect to the seat. Additionally, the seat includes an aperture disposed on the bottom portion that is configured for storing the seatback tube when it is not in use.

The present invention is directed to a child's swing that contains a frame including an upper portion and a lower portion that is configured to engage a support surface, a hanger tube that extends substantially downward from the upper portion of the frame, and a reconfigurable seat coupled to the hanger tube, the seat has a top portion and a bottom portion and is reconfigurable between a first configuration and a second configuration, the seat includes a removable tray and a removable seatback tube, where connecting the removable tray to the seat locks the seat into the first configuration.

In one embodiment, the seat includes retaining tabs configured on the bottom portion of the seat for storing the removable tray when it is not in use. The seat also includes an opening disposed on the bottom portion of the seat for storing the seatback tube when it is not in use. Moreover, the seat is biased to be in the second configuration when the removable tray is not attached to the seat.

In another embodiment, the seat includes an aperture on the top portion. Furthermore, the removable tray contains a protuberance configured to slidably engage the aperture on the top portion of the seat that locks the seat in the upright configuration.

The present invention directed to a child's swing that includes a frame containing a lower rear portion that is configured to engage a support surface, an upper rear portion that is coupled to the lower rear portion and extending substantially upward from the lower rear portion, and a front portion that extends substantially horizontally from the coupling of lower rear portion and the upper rear portion, the front portion engaging a support surface, a hanger tube pivotally coupled to the upper rear portion of the frame, the hanger tube extending substantially downward, and a reconfigurable seat coupled to the hanger tube, the seat having a top portion and a bottom portion being reconfigurable between an upright configuration and a reclined configuration, the seat contains a rotating hub with a locked upright configuration and a reclined configuration, a removable seatback tube, and a removable tray, where connecting the removable tray to the seat locks the hub into the upright configuration, retaining the seat in the upright configuration.

In one embodiment, the seat includes retaining tabs configured on the bottom portion of the seat for storing the removable tray when it is not in use. Furthermore, the seat includes an aperture on the top portion of the seat that is in communication with the rotating hub. The removable tray contains a protuberance that can be slidably inserted into the aperture to lock the hub and the seat in the upright configuration. Additionally, the seat is biased to be in the reclined configuration when the protuberance of the removable tray is not inserted into the aperture.

In another embodiment, the swing includes a removable seatback tube configured to connect to the seat via the aperture. Moreover, the seat has an opening disposed on the bottom portion for storing the seatback tube when not in use. Finally, the front portion of the frame is removable for storing the swing.

BRIEF DESCRIPTION OF THE DRAWINGS

Like reference numerals have been used to identify like elements throughout this disclosure.

DETAILED DESCRIPTION OF THE INVENTION

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

Figure 1:
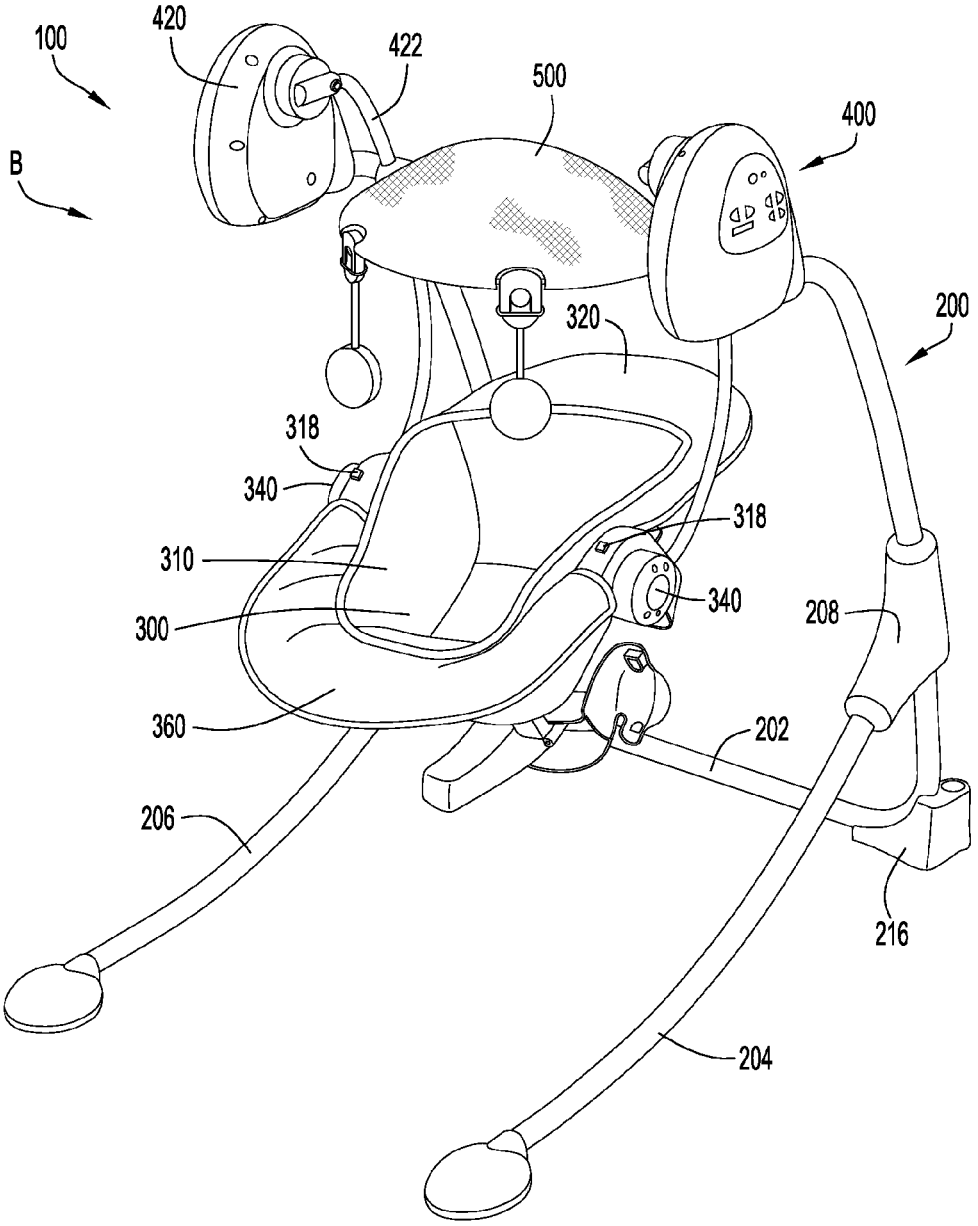
FIG. 1 illustrates a front perspective view of a child's swing apparatus according to an embodiment of the present invention, the apparatus being in the reclined configuration.
Figure 2:
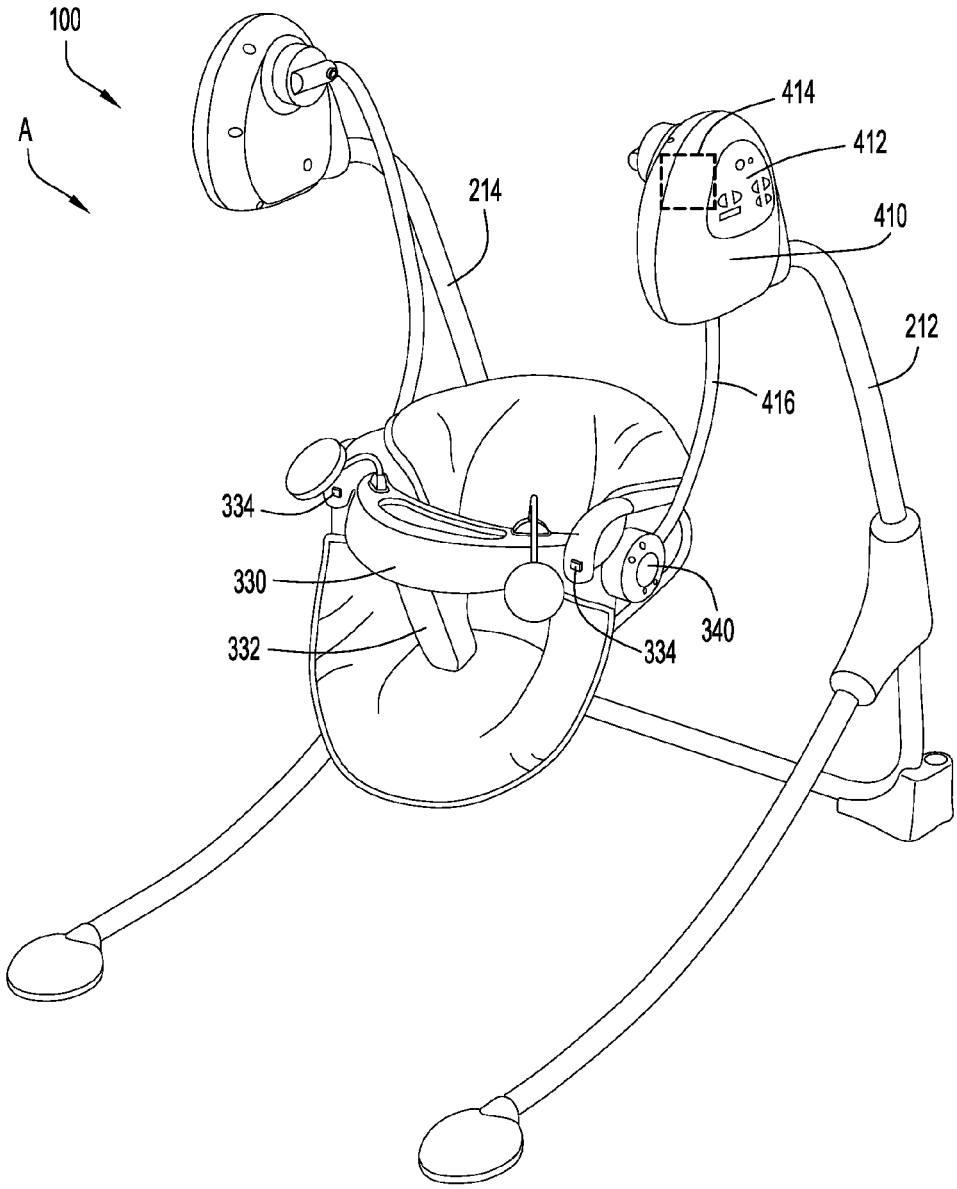
FIG. 2 illustrates a front perspective view of the apparatus of FIG. 1 with the apparatus in the upright configuration.

FIGS. 1 and 2 illustrate a swing apparatus 100 with a seat 300 that is reconfigurable between a first configuration A and a second configuration B. In this embodiment, the first configuration A may be a seat in the upright position (illustrated in FIG. 2), and the second configuration B may be a seat in a reclined position (illustrated in FIG. 1). The swing apparatus 100 contains a frame 200 that supports the swing apparatus 100 and a user on a support surface. In this embodiment, the frame consists of a lower support member 202. The lower support member 202 is positioned near the rear of the swing 100 and has a general U shape. The lower support member 202 contains a first foot base 216 and a second foot base 218 (illustrated in FIG. 6). The foot bases 216, 218 provide structure and support for the frame 200, as well as grip on the support surface. In one embodiment, the lower support member 202 may be a tubular member with a diameter of 1.125 inches and a wall thickness of 1.0 mm.

Figure 6:
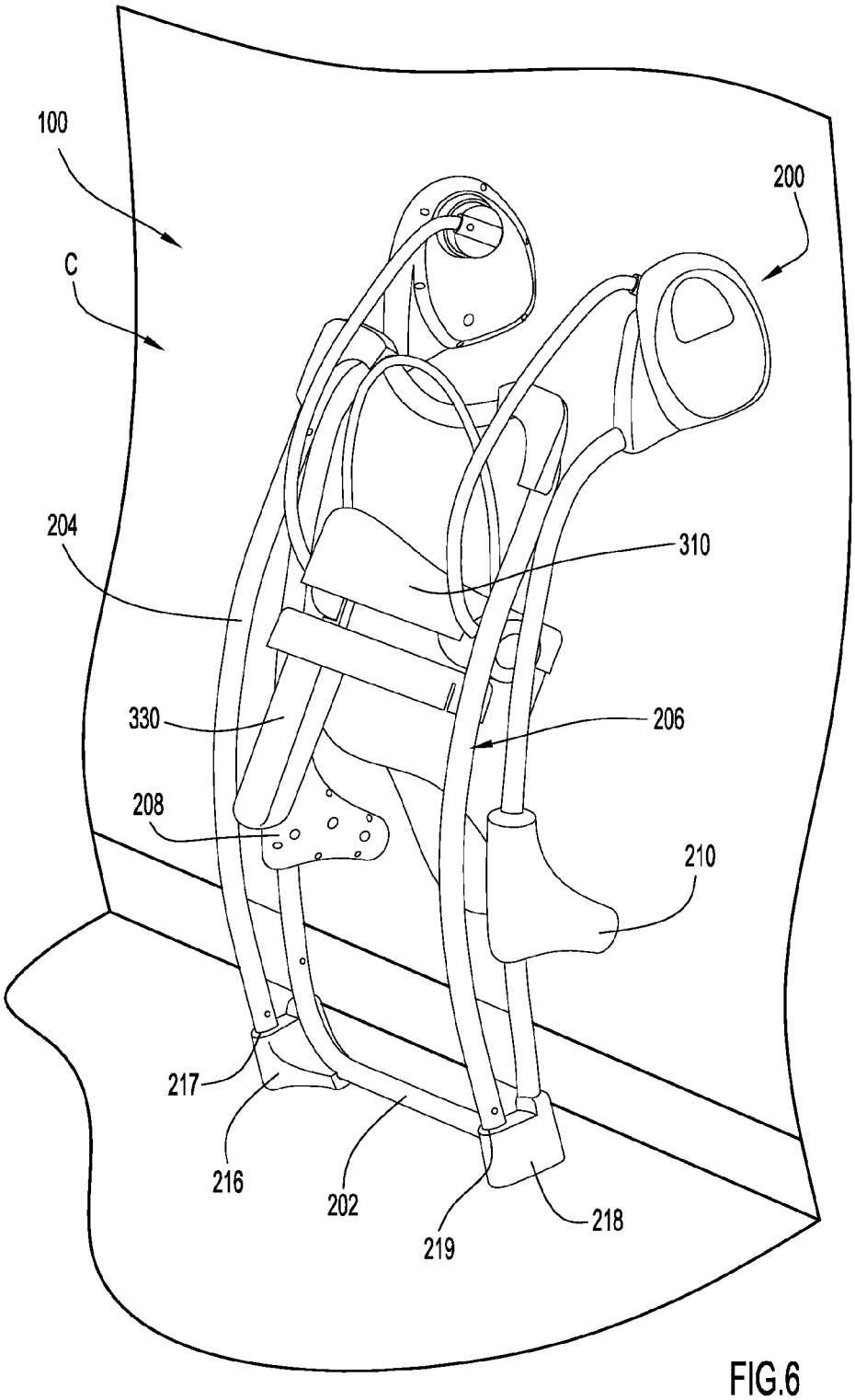
FIG. 6 illustrates a rear perspective view of the apparatus of FIG. 1 in a stored configuration.

As illustrated in FIGS. 1 and 2, attached to the ends of the lower support member 202 are a first coupling elbow 208 and a second coupling elbow 210 (illustrated in FIG. 6). Coupling elbows 208, 210 enable the lower support member 202 to be connected to the other portions of the frame 200. Extending upwardly from the first coupling elbows 208 is first upper support 212. Extending upwardly from the second coupling elbow 210 is the second upper support 214. The upper supports 212, 214 extend upwardly for supporting the swing mechanism 400. In one embodiment, the upper supports 212, 214 may have a diameter of 1.125 inches and a wall thickness of 1.0 mm.

Furthermore, as illustrated in FIGS. 1 and 2, extending forwardly from the first coupling elbow 208 is first front member 204. Similarly, extending forwardly from the second coupling elbow 210 is second front member 206. As illustrated, the front members 204, 206 engage the support surface providing lateral support for the swing apparatus, as well as support in both the fore and aft directions of the swing apparatus. The front members 204, 206 may be designed to aid the swing mechanism in gripping the support surface to prevent the swing apparatus from sliding. In one embodiment, the front members 204, 206 may have a diameter of 1.125 inches and a wall thickness of 1.0 mm.

Remaining with FIGS. 1 and 2, as illustrated, a swing mechanism 400 is coupled to the top of the upper supports 212, 214. In this embodiment, the swing mechanism 400 contains a first housing 410 and a second housing 420. First housing 410 is coupled to the top of first upper support 212, and second housing 420 is coupled to the second upper support 214. Contained within the first housing 410 is a motor 414 that is used to produce a swinging movement of the seat 300. Furthermore, first housing 410 contains an interface 412 that is used to control the swing mechanism 400 and the motor 414. The swing mechanism 400 may produce a swinging movement from the motor 414 as well as sounds and music. Moreover, the interface 412 may control the speed of the motor 414 as well as the sounds that are produced and the volume at which the sounds are produced.

Connected to the inner sides of the housings 410, 420 are hanger arms 416, 422. First hanger arm 416 is rotatably coupled to the first housing 410, and second hanger arm 422 is rotatable coupled to the second housing 420. The hanger arms 416, 422 extend downwardly from the housings 410, 420. The seat 300 is connected to the ends of both hanger arms 416, 422 that are opposite to those connected to the housings 410, 420. In one embodiment, the hanger arms 416, 422 may be tubes with a diameter of 0.75 inches and wall thickness of 1.0 mm.

As illustrated in FIGS. 1 and 2, the seat 300 is connected to the hanger arms 416, 422. The seat 300 contains a seatback 310, and rotating hubs 340. As illustrated, the hanger arms 416, 422 are connected to the seat 300 by way of the rotating hubs 340. As stated previously, FIG. 1 illustrates the seat 300 in the second configuration B, where the seat 300 is in a reclined position. In the second configuration B, the seat has seatback tube 320 connected to the seatback 310 and extending rewardly from the top of the seatback 310. Connected to the top of the seatback 310 and the seatback tube 320 is seat cover 360. When the seat 300 is in the second configuration B, the seat 300 can support an infant child. The infant can rest within the seatback 310 of the seat 300 in a reclined or laying orientation. The second configuration B of the seat 300 is beneficial to an infant because in the reclined orientation, the infant does not need to support his or her own head. In one embodiment, the seat 300 may be biased, by a spring or other similar means, to default to the second configuration B.

As the child grows, and is able to support his or her own head, the seat 300 may be configured into the first configuration A, where the seat 300 is in an upright configuration, as illustrated in FIG. 2. In one embodiment, the seat 300 may only be able to be positioned in the first configuration A when the tray 330 is attached to the top of the seatback 310, as illustrated in FIG. 2. The tray 330 contains an integrated crotch post 332 that extends downwardly from the tray 330. The integrated crotch post 332 creates two leg holes on either side of the post 332 with the seatback 310. The integrated crotch post 332 allows a child to sit within the seatback 310 without sliding out of the seat 300. Furthermore, the tray 330 contains alignment apertures 334 and locking protuberances 338 (illustrated in FIG. 4). The seatback 310 contains alignment tabs 318 that align with the alignment apertures 334 of the tray 330. The alignment apertures 334 receive the alignment tabs 318, aligning the tray 330 onto the seatback 310 properly.

Figure 3:
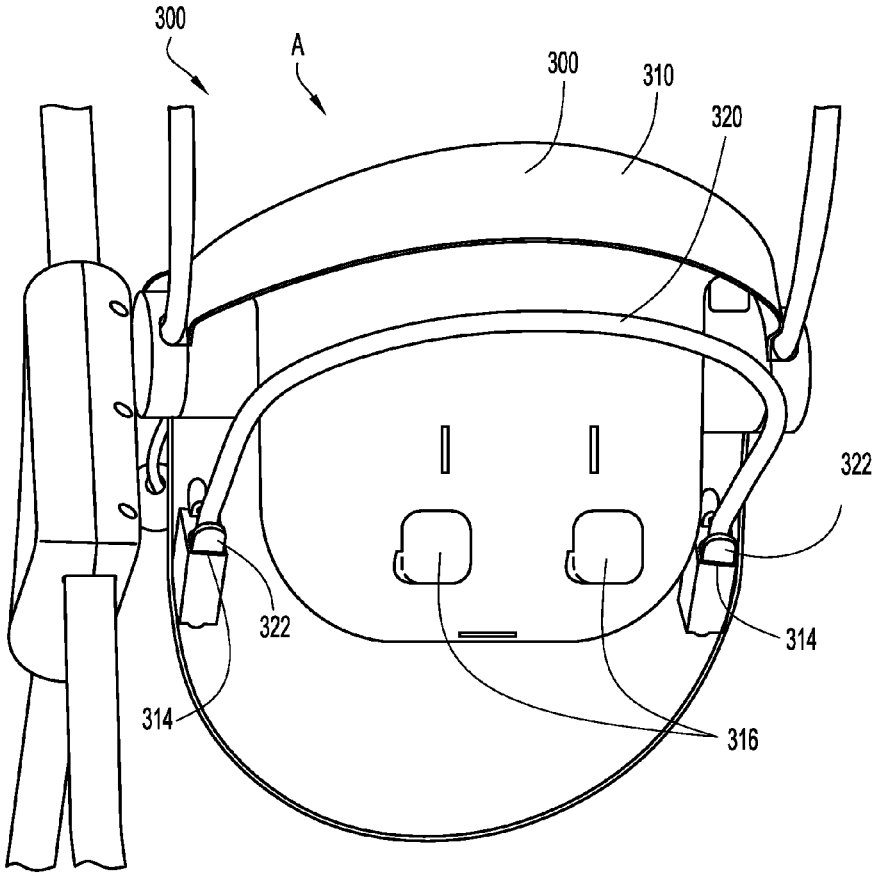
FIG. 3 illustrates a rear view of a seat of the apparatus of FIG. 2 showing the seatback tube stored underneath the seat.

Referring to FIG. 3, the rear of the seat 300 and seatback 310 is illustrated. In this embodiment, the seatback 310 contains retaining tabs 316 for storing the tray 330 (illustrated in FIG. 4) and rear apertures 314. FIG. 3 illustrates the seatback tube 320 stored underneath the seat 300 when the seat 300 is in the first configuration A. The seatback tube 320 is placed underneath the seat 300 when the seatback tube 320 is not connected to the top of the seatback 310. The rear apertures 314 are configured for storing the seatback tube 320 underneath the seatback 310 when the seat 300 is in the first configuration A. In this embodiment, the seatback tube 320 is formed from a general U-shape and contains locking tabs 322 on each end. In this embodiment, the locking tabs 322 slide into the rear apertures 314 and snap into place. To remove the seatback tube 320 from the rear apertures 314, a user must push the locking tabs 322 towards the seatback tube 320, bending the locking tabs 322 slightly. In other embodiments, the seatback tube 320 may be held in the rear apertures by other locking means such as friction, a spring loaded push button, or other similar means. In some embodiments, the seatback tube 320 may not lock into the rear apertures 314, and may just rest within the apertures 314. In some embodiments, the seatback tube 320 is a tube with a diameter of 0.5 inches and has a wall thickness of 1.0 mm.

Figure 4:
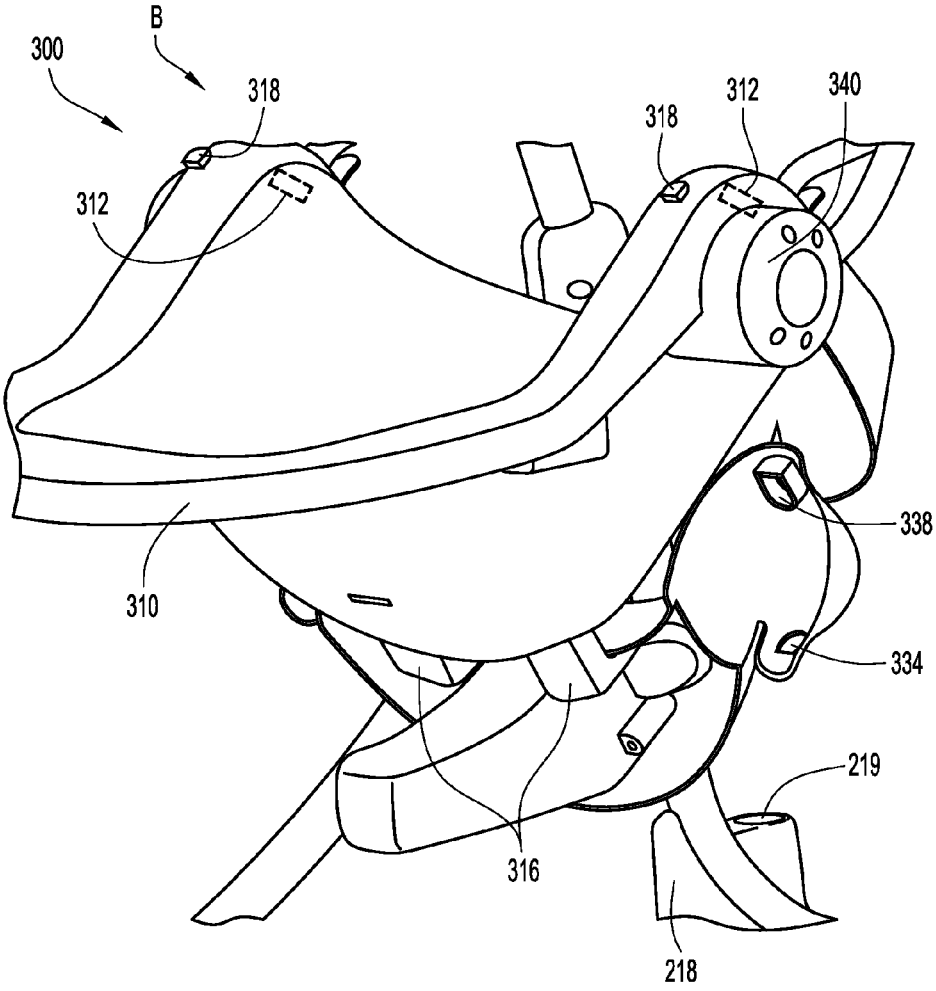
FIG. 4 illustrates a close-up front perspective view of the seat of the apparatus of FIG. 1 showing the tray stored underneath the seat.

Referring to FIG. 4, illustrated is a front perspective view of the seat 300 and seatback 310 in a second configuration B with the tray 330 stored underneath the seatback 310 on the retaining tabs 316. The retaining tabs 316 are positioned underneath the bottom of the seatback 310. In one embodiment, the retaining tabs 316 may be shaped like hooks. The retaining tabs 316 allow the removable tray 330 to be securely stored underneath the seat 300 when the tray 330 is not engaged on the seatback 310. As illustrated, the edge of the tray 330 slides onto the retaining tabs 316 to be secured to the retaining tabs 316 and the underside of the seatback 310.

Additionally, FIG. 4 illustrates the alignment tabs 318 on the front of the seatback 310. As stated previously, the alignment tabs 318 aid in the alignment of the tray 330 onto the seatback 310 by slidably engaging the alignment apertures 334 in the tray 330. Also illustrated in FIG. 4 is one of the locking protuberances 338 The locking protuberances 338 slidably engage the top apertures 312 on the top of the seatback 310 when the tray is positioned on the top of the seatback 310 to lock the hub 340 and the seat 300 into the first position A. Furthermore, when the seat 300 is in the second position B, and the seatback tube 320 is attached to the top of the seatback 310 by being inserted into the top apertures 312.

Figure 5:
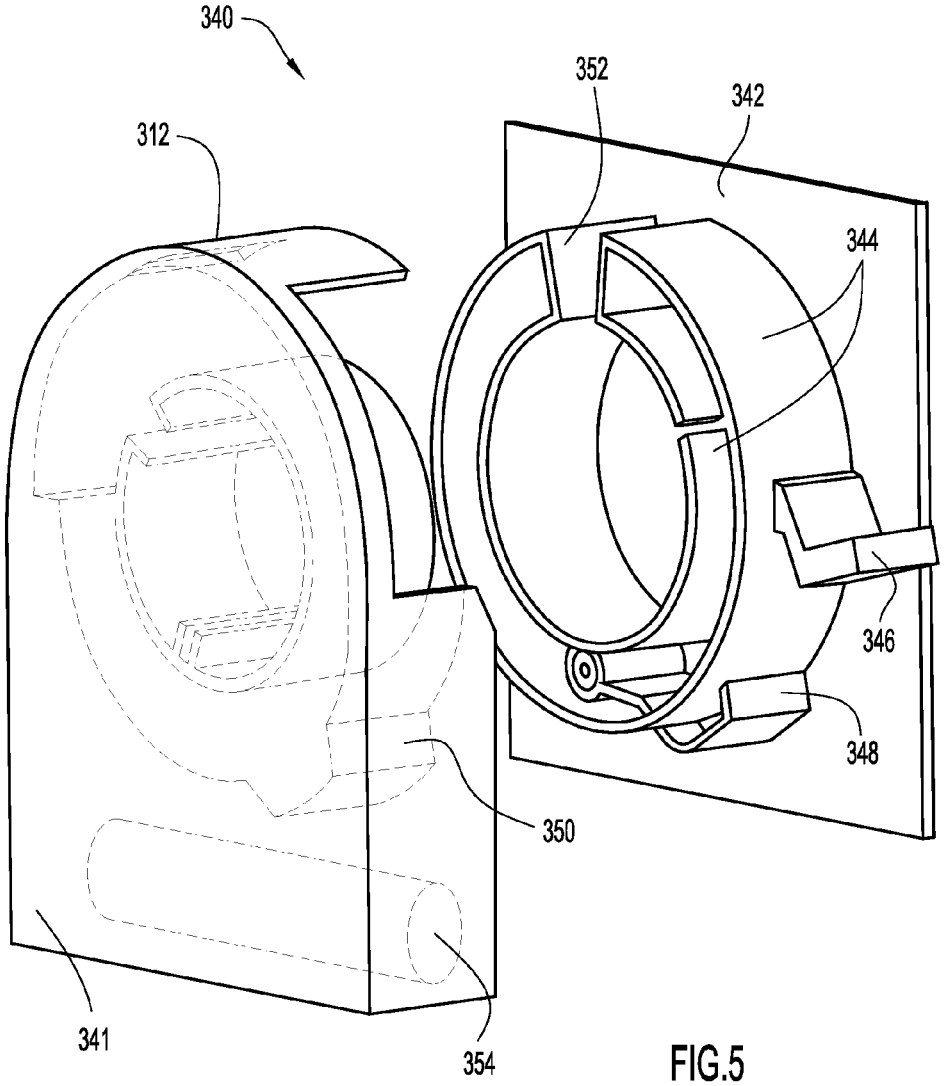
FIG. 5 illustrates an exploded view of the rotating hub of the apparatus of FIG. 1.

Referring to FIG. 5, illustrated is an exploded view of the hub 340 of the seat 300. The hub 340 consists of an outer hub 341 and an inner hub 342. The outer hub 341 is the portion of the hub 340 that can be seen by the user or parent or caregiver of the user. The inner hub 342 is positioned within the hub 340 and may be positioned partially within a portion of the seatback 310. The outer hub 341 contains a hanger arm attachment 354. The hanger arms 416, 422 attach to the hanger arm attachment 354 to support the seat 300. In one embodiment, the inner hub 342 rotates within the outer hub 341. Therefore, as the seat 300 rotates between the first configuration A and the second configuration B, the inner hub 342 rotates within the outer hub 341 while the outer hub 341 remains stationary.

FIG. 5 illustrates the inner hub 342 containing alignment rings 344, which enable the inner hub 342 to align itself within the outer hub 341. Furthermore, the inner hub 342 includes a latch 346 and a locking tab 348. The latch 346 enables a user to move the hub 340, and as a result the seat 300, between the first configuration A and the second configuration B. As stated previously, the seat 300 and the hub 340 are biased to be in the second configuration B. In this configuration, the locking tab 348 is positioned within the locking tab receiver 350 on the outer hub 341. When a user pulls up on the latch 346, the locking tab 348 rotates inward, toward the center of the inner hub 342, disengaging from the locking tab receiver 350. Once the locking tab 348 disengages the locking tab receiver 350, the inner hub 342 is able to move counter clockwise within the outer hub 341, allowing a user to move the seat 300 into the first configuration A.

Once the inner hub 342 has been rotated, and the seat 300 is in the upright orientation of the first configuration A, the tray 330 can be placed onto the seatback 310, with the locking protuberances 338 of the tray 300 sliding into the top apertures 312, as illustrated in FIG. 5. The locking protuberances 338 of the tray 330 are of a length that extends through the top apertures 312 down into the alignment rings 344. As illustrated in FIG. 5, the alignment rings 344 contain a notch 352. Once the inner hub 342 has been rotated into the orientation for the first configuration A, the notch 352 aligns with the top apertures 312. When the locking protuberances 338 slide through the top apertures 312, the protuberances 338 engage with the notch 352 of the alignment rings 344. This locks the inner hub 342 into the upright orientation of the first configuration A of the seat 300 by preventing the inner hub 342 from rotating clockwise back to the second configuration B. Once the tray 330 is removed, and the locking protuberances 338 are disengaged from the notch 352, the inner hub 342 is free to rotate clockwise, with the locking tab 348 engaging the locking tab receiver 350. In some embodiments, a torsion spring (not shown) may interact with the inner hub 342 and the outer hub 341 to spring bias the seat 300 to the second configuration B. In one embodiment, the top apertures 312 may be located in the outer hub 341 of the rotating hub 340. In other embodiments, the top apertures 312 may be located on the top of the seatback 310, as illustrated in FIG. 4. Moreover, the locking tabs 322 of seatback tube 320 are not of a length that are engageable with the notch 352 of the alignment ring 344.

Figure 5A:
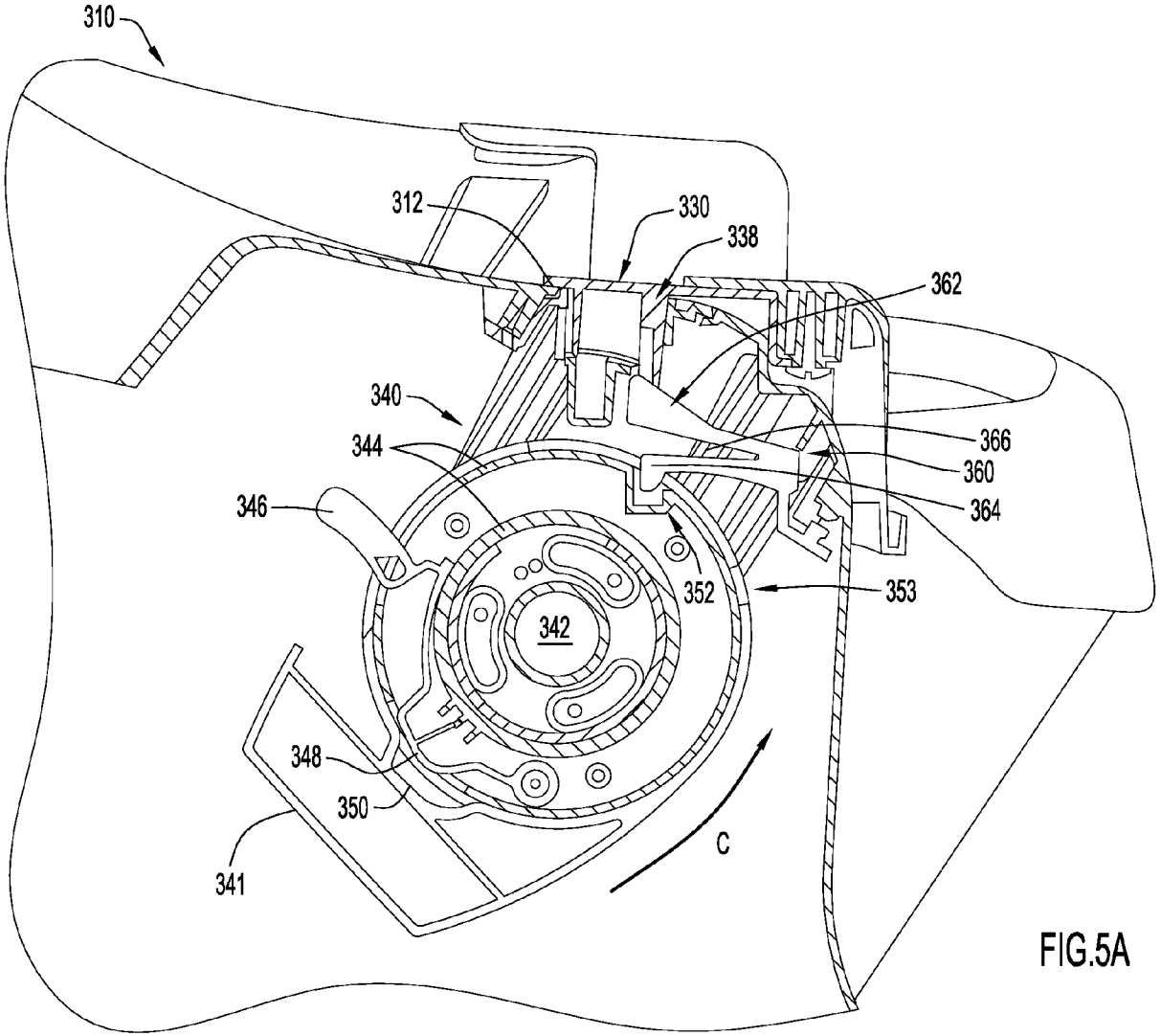
FIG. 5*a* illustrates a sectional view of another embodiment of the rotating hub of FIG. 5.

Referring to FIG. 5*a*, illustrated is a sectional view of a second embodiment of the hub 340 and the seatback 310. Similar to the previous embodiment of FIG. 5, the hub 340 includes an outer hub 341 and an inner hub 342 with alignment rings 344. In this embodiment, the inner hub 342 is connected to the sides of the seat 300 and the outer hub 341 is connected to the hanger arms 416. Moreover, the seatback 310 contains the top apertures 312. When the seat 300 moves between first configuration A and second configuration B, the inner hub 342 rotates within the outer hub 341 about rotation C. As illustrated in FIG. 5*a*, the inner hub contains notch 352 and outer hub contains aperture 353. Further illustrated is a pivot latch 360 that is positioned below the top apertures 312 in the seatback 310 and above the hub 340. The pivot latch 360 contains an upper arm 362 and a lower arm 364 that form a V-shaped configuration with a gap 366 between the ends of the upper arm 362 and the lower arm 364. The upper arm 362 is aligned with the top aperture 312 and the lower arm 364 is aligned with the notch 352 in the inner hub 342.

As illustrated in FIG. 5*a*, when the seat 300 is rotated to first configuration A, the aperture 353 in the outer hub 341 aligns with the notch 352 in the inner hub 342. Additionally, once the tray 330 is placed on the seatback 310 with the locking protuberances 338 inserted into the top apertures 312, the locking protuberances 338 engage the upper arm 362 of the pivot latch 360 causing the pivot latch 360 to pivot. The pivoting by the pivot latch 360 inserts the lower arm 364 to into the aligned aperture 353 and notch 352 locking the seat 300 in the first configuration A and preventing the outer hub 341 and inner hub 342 from rotating. However, if the seat 300 is in the second configuration B, the aperture 353 is misaligned with notch 352. If the locking protuberances 338 are inserted into the top apertures 312 when the seat is in the second configuration B, the lower arm 364 of the pivot latch cannot be inserted into the aperture 353 and notch 352. When the seat 300 is in the second configuration B, the lower arm 364 of the pivot latch 360 rests on the outside of the outer hub 341. This position of the lower arm 364 pivots the pivot latch 360 and the upper arm 362 so that the upper arm 362 is located proximate to the top aperture 312. When the upper arm 362 is located proximate to the top aperture 312 and the lower arm 364 is resting on the outside of the outer hub 341, the outer hub 341 and the inner hub 342 are not locked together by the lower arm 364.

Furthermore, as the tray 330 is placed on the seatback 310 with the locking protuberances 338 inserted into the top apertures 312, the insertion of the seatback tube 320 into the top apertures 312 is prevented. Therefore, the seatback tube 320 and the tray 330 cannot be attached to the seatback 310 at the same time. This condition insures that the user operates the swing apparatus 100 with the seat 300 in the first and second configurations A, B as intended, preventing possible injury to an infant placed within the seatback 310 of the swing apparatus 100.

Referring to FIG. 6, the swing apparatus 100 is shown in a storage configuration C. In this configuration, the front members 204, 206 have been removed from the coupling elbows 208, 210. As illustrated in FIG. 6, the first foot base 216 contains an aperture 217 and the second foot base 218 contains an aperture 219. When the swing apparatus 100 is configured to the storage configurations C, the first front member 204 is removed from the first coupling elbow 208 and placed in the aperture 217 on the first foot base 216. Similarly, the second front member 206 is removed from the second coupling elbow 210 and placed in the aperture 219 on the second foot base 218. In some embodiments, the front members 204, 206 may be frictionally engaged into the coupling elbows 208, 210 and the apertures 217, 219 of the foot bases 216, 218. In other embodiments, the front members 204, 206 may be held into place in the coupling elbows 208, 210 and the foot bases 216, 218 by spring loaded buttons, or other similar means. In the storage configuration C, the swing apparatus 100 may be leaned against a wall or placed within a closet for easy convenient storage.

Figure 7:
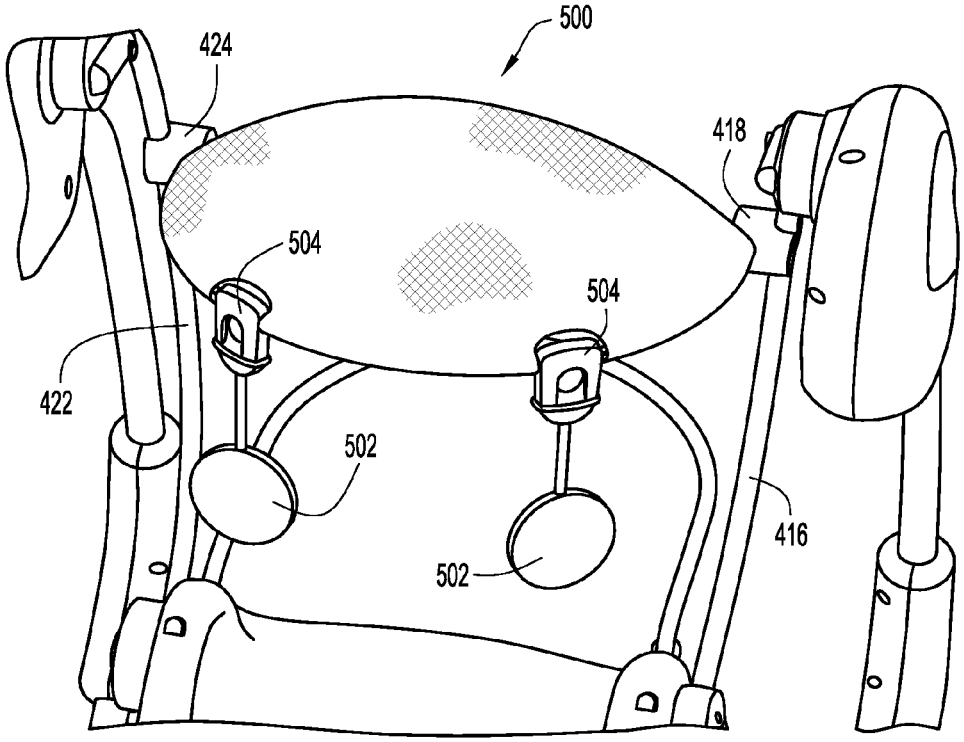
FIG. 7 illustrates a top perspective view of the canopy of the apparatus of FIG. 1.

Referring to FIG. 7, illustrated is the canopy 500 attached to the hanger arms 416, 422. The hanger arms 416, 422 may contain coupling members 418, 424. The coupling members 418, 424 allow a canopy 500 to be attached to the hanger arms 416, 422. The canopy 500 is used for entertaining a child within the seat 300 or for shading a child from excess light. Furthermore, the canopy 500 may contain toy objects 502 that hang from the canopy 500 via clips 504. The clips 504 enable a user to easily remove or attach the toy objects 502 to and from the canopy 500. This allows a parent or care giver to position different toy objections 502 onto the canopy 500 for the child to interact with. In some embodiments, the coupling members 418, 424 may be removably engaged with the hanger arms 416, 422. Furthermore, the canopy 500 may be removably engaged with the coupling members 418, 424.

What is claimed is:

1. A child's swing, comprising:

a frame including a lower portion configured to engage a support surface and an upper portion;

a mounting portion coupled to the upper portion of the frame, the mounting portion including a hanger tube extending substantially downward from the mounting portion;

a reconfigurable seat coupled to the hanger tube, the seat having a top portion and a bottom portion and being reconfigurable between a first configuration and a second configuration, the seat comprising:

at least one rotating hub with a first configuration and a second configuration, a removable tray; and a drive mechanism coupled to the mounting portion, the drive mechanism configured to swing the seat back and forth relative to the swing frame, wherein connecting the removable tray to the seat locks the hub into the first configuration, retaining the seat in the first configuration.

2. The swing of claim 1, wherein the seat further comprises:

retaining tabs configured to the bottom portion of the seat configured for storing the removable tray when the removable tray is not connected to the seat.

3. The swing of claim 1, further comprising:

a removable seatback tube configured to connect to the seat.

4. The swing of claim 3, wherein the seat further comprises:

at least one aperture disposed on the bottom portion of the seat, the aperture is configured for storing the seatback tube.

5. The swing of claim 1, wherein the seat and the hub are biased to be in the second configuration when the removable tray is not attached to the seat.

6. The swing of claim 1, further comprising:

a seat cover disposed on the top portion of the seat.

7. A child's swing, comprising:

a frame including an upper portion and a lower portion configured to engage a support surface;

at least one hanger tube extending substantially downward from the upper portion of the frame; and a reconfigurable seat coupled to the hanger tube, the seat having a top portion and a bottom portion and being reconfigurable between a first configuration and a second configuration, the seat comprising:

a removable tray, a removable seatback tube, wherein connecting the removable tray to the seat locks the seat into the first configuration.

8. The swing of claim 7, wherein the seat further comprises:

retaining tabs configured to the bottom portion of the seat configured for retaining the removable tray when the removable tray is not connected to the seat.

9. The swing of claim 7, wherein the seat further comprises:

at least one opening disposed on the bottom portion of the seat, the opening is configured for retaining the seatback tube when not in use.

10. The swing of claim 7, wherein the seat is biased to be in the second configuration when the removable tray is not attached to the seat.

11. The swing of claim 7, wherein the seat further comprises:

at least one aperture on the top portion of the seat.

12. The swing of claim 11, wherein the removable tray further comprises:

at least one protuberance configured to slidably engage the aperture on the top portion of the seat, locking the seat in the upright configuration.

13. A child's swing, comprising:

a frame comprising:

a lower rear portion configured to engage a support surface, an upper rear portion coupled to the lower rear portion and extending substantially upward from the lower rear portion, and a front portion extending substantially horizontal from the coupling of lower rear portion, the front portion is configured to engage a support surface;

a hanger tube pivotally coupled to the upper rear portion of the frame, the hanger tube extending substantially downward; and a reconfigurable seat coupled to the hanger tube, the seat having a top portion and a bottom portion and being reconfigurable between an upright configuration and a reclined configuration, the seat comprising:

at least one rotating hub with a locking upright configuration and a reclined configuration, a removable seatback tube, and a removable tray, wherein connecting the removable tray to the seat locks the the hub into the upright configuration, retaining the seat in the upright configuration.

14. The swing of claim 13, wherein the seat further comprises:

retaining tabs configured to the bottom portion of the seat configured for storing the removable tray when the removable tray is not connected to the seat.

15. The swing of claim 13, wherein the seat further comprises:

at least one aperture on the top portion of the seat, the one aperture is configured to be in communication with the rotating hub.

16. The swing of claim 15, wherein the removable tray further comprises:

at least one protuberance configured to slidably engage the aperture on the top portion of the seat and the hub, locking the hub and the seat in the upright configuration.

17. The swing of claim 15, further comprising:

a removable seatback tube configured to connect to the seat via the aperture on the top portion of the seat.

18. The swing of claim 17, wherein the seat further comprises:

at least one opening disposed on the bottom portion of the seat, the opening is configured for retaining the seatback tube when not in use.

19. The swing of claim 13, wherein the seat is biased to be in the reclined configuration when the removable tray is not attached to the seat.

20. The swing of claim 13, wherein the front portion of the frame is removable for storage of the swing.

* * * * *